US005595153A

United States Patent [19]

Höppner et al.

[11] Patent Number: 5,595,153

[45] Date of Patent: Jan. 21, 1997

[54] PORTABLE HANDHELD WORK APPARATUS HAVING A FILTER CASE

[75] Inventors: Klaus Höppner, Marbach; Karl Förderer, Schwaikheim; Georg Lohse, Waiblingen; Klaus-Martin Uhl, Baltmannsweiler, all of Germany

[73] Assignee: Andreas Stihl, Waiblingen, Germany

[21] Appl. No.: 387,470

[22] Filed: Feb. 13, 1995

[30] Foreign Application Priority Data

Feb. 11, 1994 [DE] Germany ..... 44 04 465.8

[51] Int. Cl.[6] ..... F01P 1/02

[52] U.S. Cl. ..... 123/198 E; 30/381

[58] Field of Search ..... 123/195 C, 198 E, 123/195 HC; 30/381

[56] References Cited

U.S. PATENT DOCUMENTS

| | | | |
|---|---|---|---|
| 3,731,846 | 5/1973 | Turner et al. | 222/105 |
| 4,382,333 | 5/1983 | Nagashima et al. | 30/381 |
| 4,548,169 | 10/1985 | Nagashima | 123/195 C |
| 4,770,130 | 9/1988 | Nagashima | 123/41.67 |
| 4,788,951 | 12/1988 | Nagashima | 123/195 C |
| 4,793,303 | 12/1988 | Nagashima | 123/198 E |
| 4,936,271 | 6/1990 | Nagashima et al. | 123/195 C |
| 4,953,526 | 9/1990 | Hironaka et al. | 123/195 C |
| 5,018,492 | 5/1991 | Wolf et al. | 123/198 E |
| 5,233,945 | 8/1993 | Wolf et al. | 30/381 |
| 5,243,764 | 9/1993 | Wieland | 30/381 |
| 5,243,939 | 9/1993 | Viktorsson et al. | 30/381 |
| 5,367,988 | 11/1994 | Collins | 123/198 E |
| 5,522,355 | 6/1996 | Uhl | 123/195 C |

FOREIGN PATENT DOCUMENTS

| | | | |
|---|---|---|---|
| 949627 | 6/1974 | Canada . | |
| 2573132 | 5/1986 | France . | |
| 3819728 | 1/1989 | Germany | 123/198 E |
| 3916414 | 12/1989 | Germany . | |
| 2274408 | 7/1994 | United Kingdom | 123/198 E |

*Primary Examiner*—David A. Okonsky
*Attorney, Agent, or Firm*—Walter Ottesen

[57] ABSTRACT

The invention relates to a portable handheld work apparatus such as a motor-driven chain saw. The apparatus includes an internal combustion engine as a drive motor for a work tool. The engine is mounted in a housing. The engine draws combustion air from the clean compartment of a filter case via an intake channel. The clean compartment is partitioned from a dirt compartment of the filter case by an air filter. The filter case itself is closed by a hood. The cover is configured as a hood of the motor housing and is pivoted about a pivot axis which is held to the motor housing by at least one bearing. In this way, the air-filter case can be cleaned in a simple manner without a tool. When the hood is flipped open, the filter case is freely accessible so that the necessary maintenance of the air filter or cleaning of the filter case is possible.

14 Claims, 10 Drawing Sheets

PORTABLE HANDHELD WORK APPARATUS HAVING A FILTER CASE

BACKGROUND OF THE INVENTION

Motor-driven chain saws driven by an internal combustion engine are operated in dirt-laden areas. For this reason, appropriate air filters must be provided. On the one hand, it is desired that the combustion air supplied to the engine be as free of dirt as possible while, on the other hand, the requirement is imposed that there be as few interruptions in work as possible because of needed filter changes or filter cleaning steps. The number of needed filter maintenance steps can be reduced by utilizing suitable air-filter elements; however, filter maintenance steps must nonetheless be carried out at regular intervals in order to guarantee a trouble-free operation of the engine.

In known motor-driven chain saws, a cover must be removed for cleaning the air filter and the filter housing. This cover is mostly secured with the aid of screws. Tools are most often required to loosen these screws. The cover has, in most cases, the size of the filter element so that, after removal of the cover, the filter element is indeed accessible but because the access opening is too small, further cleaning operations on the filter housing are very difficult and therefore very time consuming.

SUMMARY OF THE INVENTION

It is an object of the invention to provide a work apparatus of the kind described above wherein filter maintenance work can be carried out in a simple manner and without tools.

The portable handheld apparatus of the invention is an apparatus such as a motor-driven chain saw, cutoff machine or the like. The apparatus has a work tool and includes: a housing having an opening through which ambient air flows into the housing; an internal combustion engine for driving the work tool; the engine being mounted in the housing and having an air-intake channel; the housing including a filter case arranged therein; an air filter mounted in the filter case and partitioning the filter case into a first compartment communicating with the opening for receiving the ambient air and a clean compartment for receiving air for combustion through the air filter from the first compartment; the air-intake channel being arranged in the housing so as to communicate with the clean compartment for receiving filtered air for combustion in the engine; the housing having a hood covering the filter case; and, pivot bearing means for pivotally connecting the hood to the housing.

A large opening is exposed by configuring the cover as a hood of the motor housing pivotable about an axis. Filter maintenance work can be carried out simply and quickly through this opening. The hood is held via bearings on the engine housing and, for this reason, it is only necessary to latch the hood in order to close the filter housing for which simple latching devices are suitable which can be manipulated without a tool.

Preferably, the bearing comprises a bearing mount fixed to the engine housing and a bearing pin arranged on the cover. The bearing mount has a radial insert opening for the bearing pin with the insert opening facing toward the filter case. After the hood is flipped open, its removal is simple so that the hood itself does not constitute a disturbance when performing maintenance and cleaning operations on the filter case.

In a preferred further embodiment of the invention, the clean compartment is delimited by the hood and a filter support. The filter element faces toward the clean compartment and is preferably held on the filter support by holders provided on the hood. In this way, the fixing of the filter on the filter support is removed when the hood is flipped open so that the filter element can be manually removed and cleaned without an additional tool.

In a further embodiment of the invention, the filter support defines a partition wall between a smoothing compartment and the clean compartment. The smoothing compartment is connected to the dirt compartment of the filter housing via at least one intake pipe. The smoothing chamber guarantees a prefiltering of the inflowing combustion air so that the entrained dirt which is to be held back by the filter element is less. The service time of the air filter is thereby increased. Furthermore, the possibility is provided to significantly attenuate intake noise by appropriately configuring the intake pipe in accordance with the principle of a Helmholtz resonator so that the work apparatus exhibits a reduced noise level.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
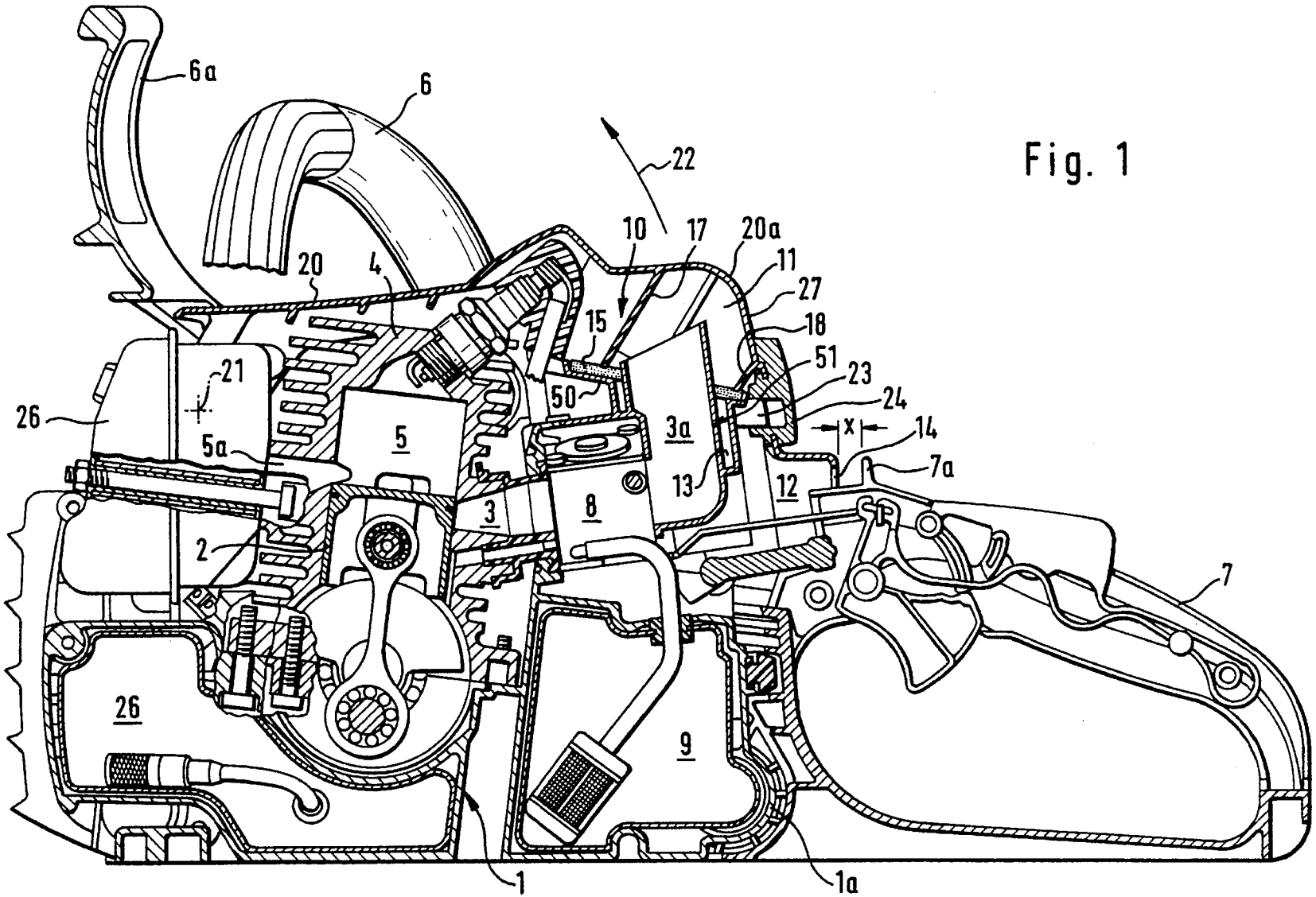
FIG. 1 is an elevation view, in section, of a motor-driven chain saw.

The portable handheld work apparatus shown in FIG. 1 is a motor-driven chain saw which comprises an internal combustion engine 2 mounted in a motor housing 1. The drive motor in the embodiment shown is a two-stroke engine and is provided to drive a work tool.

For guiding and manipulating the motor-driven chain saw, a rearward handle 7 as well as a forward handle 6 are provided. The rearward handle extends in the longitudinal direction of the chain saw and the forward handle is configured as a bail handle and engages around the motor housing in the forward region thereof. The handles 6 and 7 preferably define a one-piece assembly unit which is separated from the motor housing 1 via anti-vibration elements 1*a* so that the vibrations of the engine are transmitted attenuated to the handles.

The internal combustion engine 2 is configured as a single cylinder engine having a cylinder 4 which essentially stands upright. The combustion chamber 5 of the engine is supplied via an intake channel 3 with an ignitable air/fuel mixture from a carburetor 8. The carburetor 8 is supplied width fuel from a fuel tank 9 mounted in the motor housing 1.

The outlet 5*a* to a muffler 25 is provided in the wall of the combustion chamber 5 opposite the intake channel 3. The exhaust-gas discharge of the muffler is at the forward end face of the motor-driven chain saw. An oil tank 26 is provided below the muffler 25 and an oil pump pumps oil from the oil tank 26 into the guide groove of a guide bar (not shown) in order to ensure a friction-free movement of the saw chain on the guide bar.

Figure 5:
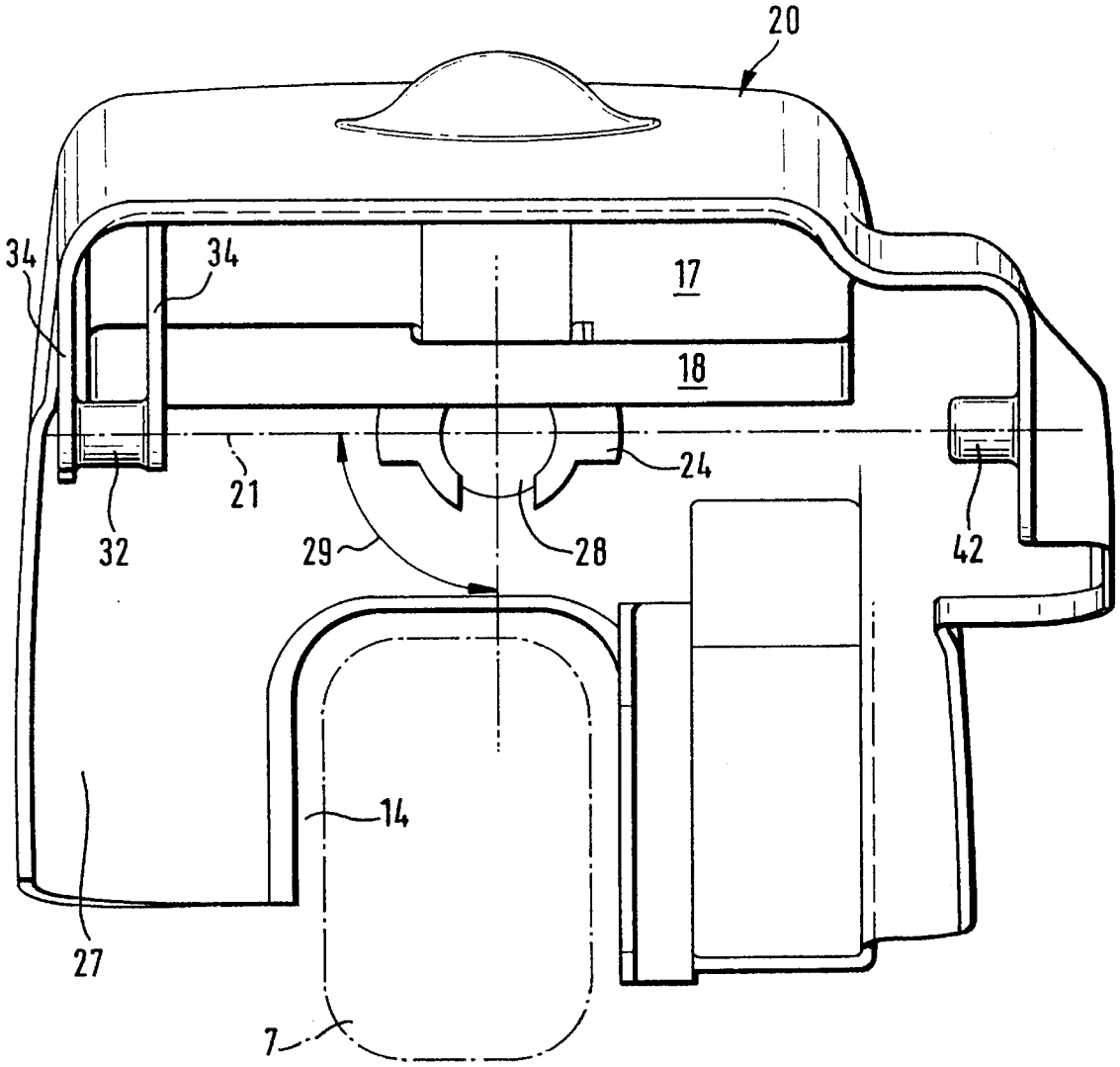
FIG. 5 is a view of the hood.

The carburetor 8 is disposed in the filter case 10 which is configured between the motor housing 2 and an overlapping hood 20. A clean compartment 11 is provided in the filter case 10 and an inlet section of the intake channel 3 opens into the clean compartment. The inlet section 3*a* is configured as a connecting stub which is fixed on the carburetor 8 with its shorter leg. The longer leg projects upright into the clean compartment 11 which is delimited by the hood 20 and a filter element 15. The filter element 15 faces toward the clean compartment 11 and is placed upon a filter support 50 which is essentially fixed relative to the motor housing and is on the carburetor. The air-filter element 15 is fixed on the filter support 50 by holding means. This holding means is preferably configured as a single piece with the hood 20 and is defined by boundary walls 17 and 18 mounted in the hood 20. The boundary walls 17 and 18 extend over the entire width of the hood 20 as shown in FIG. 5 so that the clean compartment 11 is defined by: the boundary walls (17, 18), the air-filter element 15 and a section 20*a* of the hood. The inlet section 3*a* projects through the filter support 50 and the filter element 15 so that the inlet opening of the inlet section 3*a* lies above the air-filter element 15.

The filter support 50 further defines a partition wall between a smoothing compartment 13 and the clean compartment 11. The smoothing compartment 13 is connected to the dirt compartment 12 via at least one intake duct 19 (see FIGS. 6 and 7). The dirt compartment 12 communicates with the atmosphere via a housing opening 14. The rearward handle 7 projects into the housing opening 14. In this way, a peripheral gap is formed which surrounds the rearward handle 7. This gap defines a vibration gap between the motor housing which vibrates and the rearward handle 7 coupled thereto in a manner so that vibrations are attenuated. For reasons of safety, a cover flange 7*a* is provided forward of the vibration gap 14 at a spacing (x) therefrom. The cover flange 7*a* surrounds the handle 7 and is preferably formed as one piece therewith.

Figure 6:
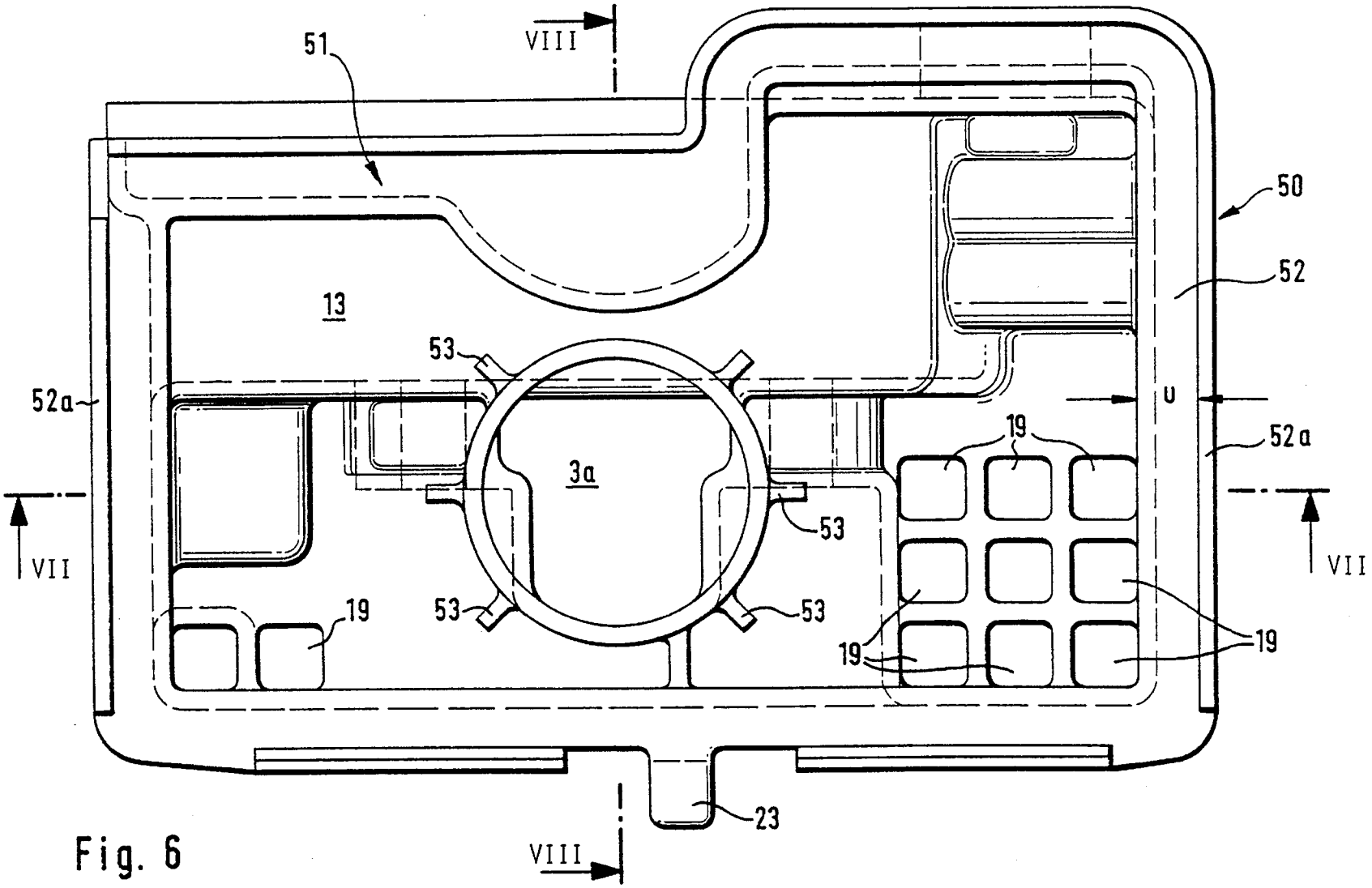
FIG. 6 is a plan view of a filter case.

The following conjointly define a single assembly unit 51 shown in FIGS. 6 to 9: the filter support 50, the inlet section 3*a* of the intake channel 3, the smoothing compartment 13 and at least one intake duct 19. FIG. 6 shows that the filter support 50 essentially comprises a peripherally extending support step 52 having a width (u). The inlet section 3*a* of the intake channel 3 is configured as one piece with the filter support. The intake channel 3*a* has short radial supporting legs 53 having respective free ends so that the filter element (not shown in FIGS. 6 to 9) is supported approximately in the center by the support legs 53 of the inlet section 3*a* projecting into the clean compartment 11. The partition wall between the smoothing compartment 13 and the clean compartment 11 is thereby exclusively defined by the air-filter element 15. The smoothing compartment 13 is configured in the assembly component and the air-filter element 15 is held on the filter support 50. This affords the advantage that dirt particles possibly entering into the smoothing compartment 13 can be easily removed because the smoothing compartment 13 is freely accessible after the air-filter element is removed.

Intake ducts 19 open into the smoothing compartment 13. In the embodiment shown, a preferably square block of nine intake ducts 19 opens into a first corner of the smoothing compartment 13. In a second corner of the smoothing compartment, additional intake ducts 19 can advantageously open into the smoothing compartment. In the embodiment shown, in the second corner of the longitudinal side of the smoothing compartment 13, two additional intake ducts 19 are provided. The smoothing compartment 13 is essentially configured so as to be rectangular on all sides. The lengths of the intake ducts are configured in the manner of Helmholtz resonators for the purpose of attenuating noise. Accordingly, the ducts have a corresponding length L (see FIG. 7) which is dependent upon their pass-through cross section. The assembly unit 51 has a connecting end 55 (see FIG. 8) facing toward the carburetor 8. This connecting end 55 is so configured that it partially engages around the carburetor 8 (see FIG. 1) and can be fixedly mounted thereto. The assembly unit 51 is therefore fixedly built into the motor housing via the carburetor. A direct connection to the motor housing can be advantageous.

Figure 7:
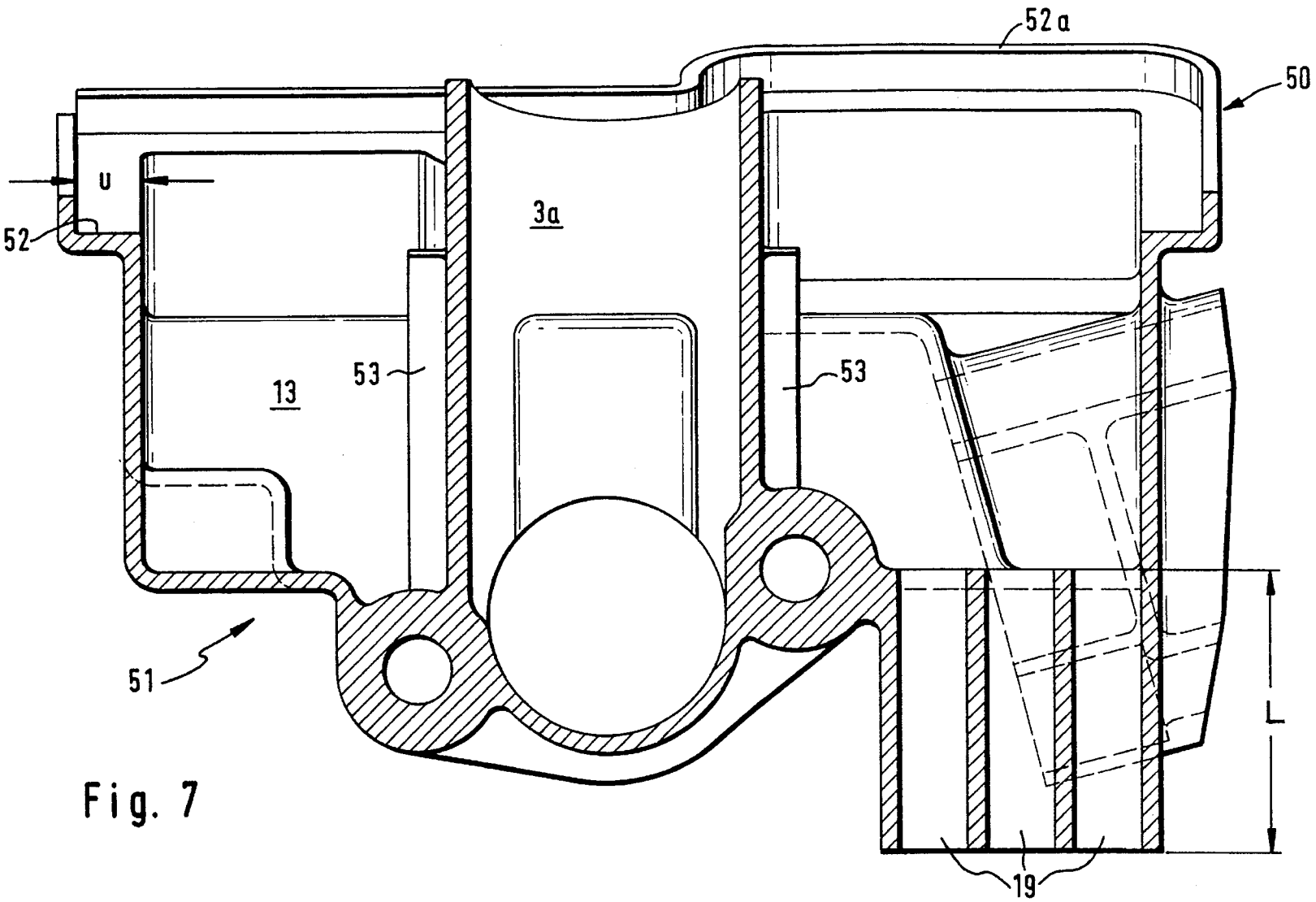
FIG. 7 is a section view through the filter case along line VII—VII of FIG. 6.
Figure 8:
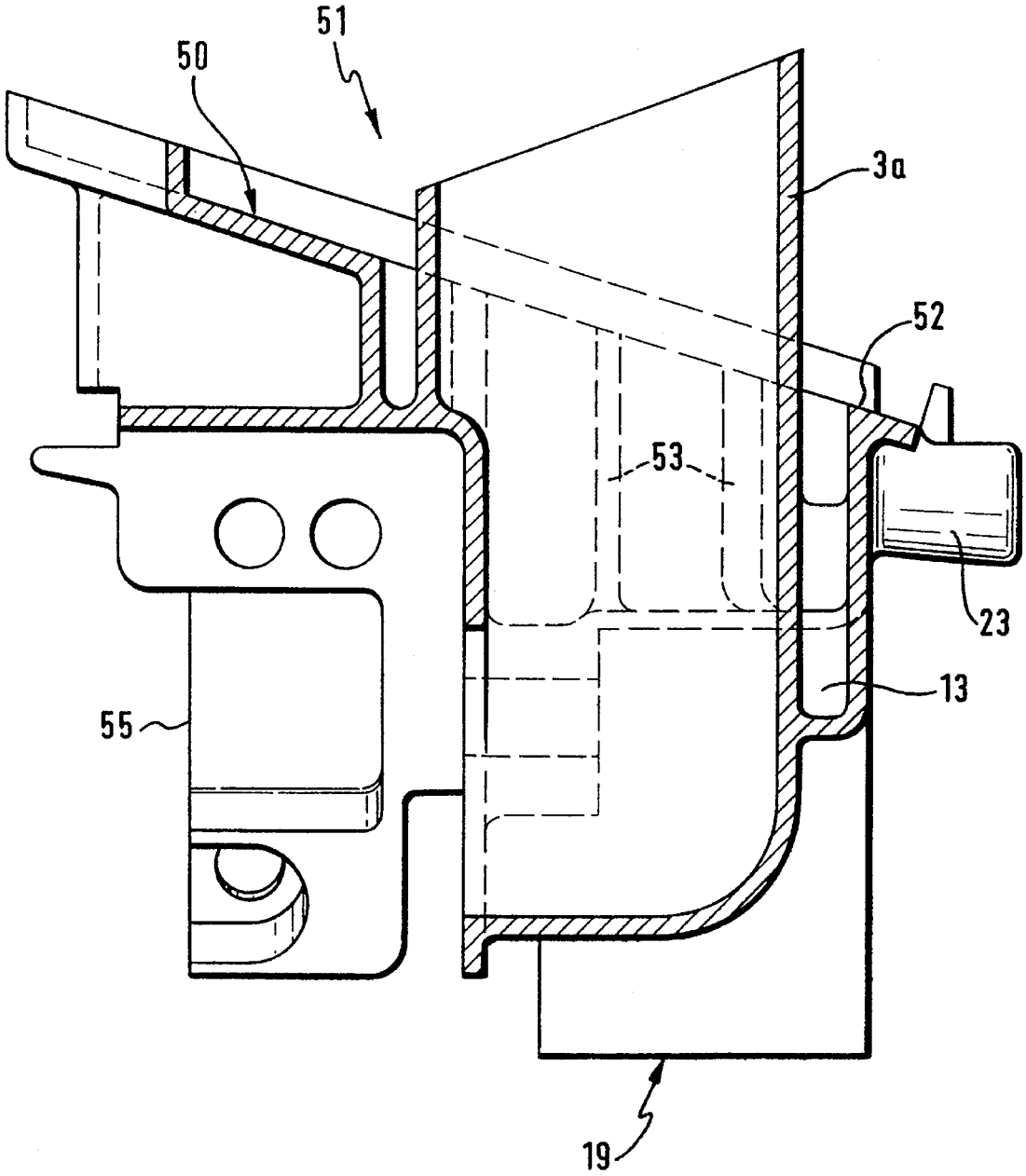
FIG. 8 is a section view through the filter case along line VIII—VIII of FIG. 6.
Figure 9:
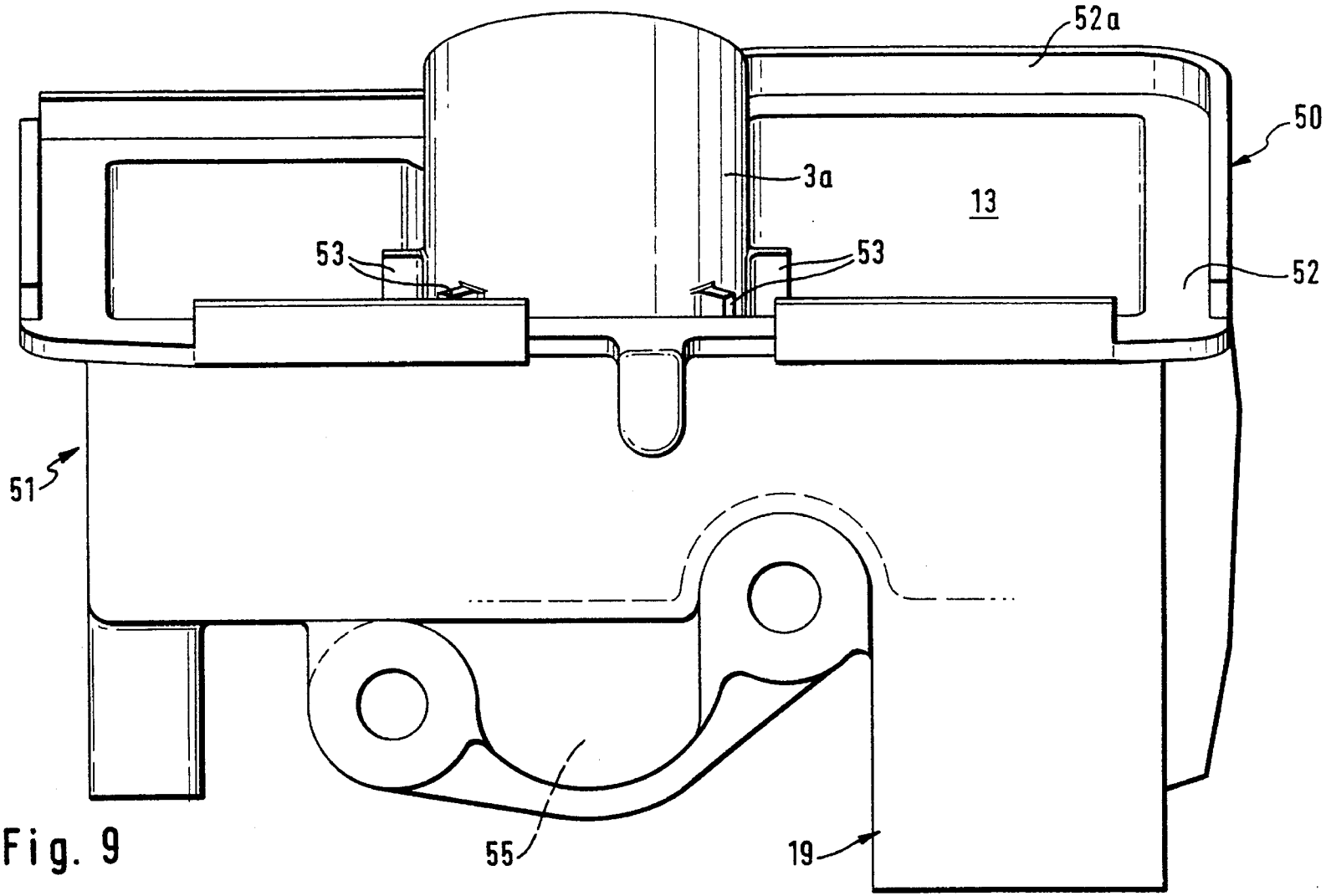
FIG. 9 is a plan view of the filter case as seen from the connecting end of the carburetor; and, FIG. 10 is a further embodiment of a covering hood mounted on the motor housing with a filter case.

As can be seen in the section views of FIGS. 7 and 8, as well as in the view from the carburetor connecting end (FIG. 9), the support step 52 has a peripheral wall 52*a* which is partially interrupted. With this wall 52*a*, an air-filter element placed on the filter support 50 is held in its position reliably closing off the smoothing compartment 13.

The boundary walls (17, 18) of the hood 20 (FIG. 1) function as hold-down means and lie approximately above the support step 52 of the assembly unit 51 when the filter case 10 is closed. The support step 52 extends perpendicularly to the longitudinal axis of the chain saw. This ensures that the pressure forces guarantee that the air-filter element is clamped between the support step 52 and the hood 20. The pressure forces are applied when the hood is closed to obtain the necessary sealing action by the boundary walls (17, 18). The arrangement of the boundary walls (17, 18) and of the filter support 50 (more specifically, its support step 52 lying in a plane) is so determined that the boundary walls (17, 18) lie approximately perpendicularly to the plane of the support step 52.

The assembly unit 51 is tightly mounted to the motor housing. For this reason, the catch of the hood 20 can engage on the assembly unit 51. The hood 20 is flipped open about a pivot axis 21 in the direction of arrow 22. A closure latch 23 is provided for latching the hood to the assembly unit 51 and lies approximately in the longitudinal center axis of the work apparatus. The closure latch 23 projects rearwardly in the direction of the handle 7. A catch in the form of a closure knob 24 is provided to coact with the closure latch 23. The closure knob 24 is rotatable in the end face 27 of the hood and faces toward the rearward handle 7. The closure knob 24 has a receiving slot 28 on the end thereof facing toward the closure latch 23. The closure latch 23 is introduced into the receiving slot 28 when the hood is closed as shown in FIG. 5. With the hood 20 closed, the closure knob 24 is rotated by 90° in the direction of arrow 29 so that, in the opening direction (arrow 22 in FIG. 1) of the hood 20, the closure latch 23 is latched form-tight in the receiving slot 28. For this reason, the hood 20 is latched tightly to the motor housing.

Figure 2:
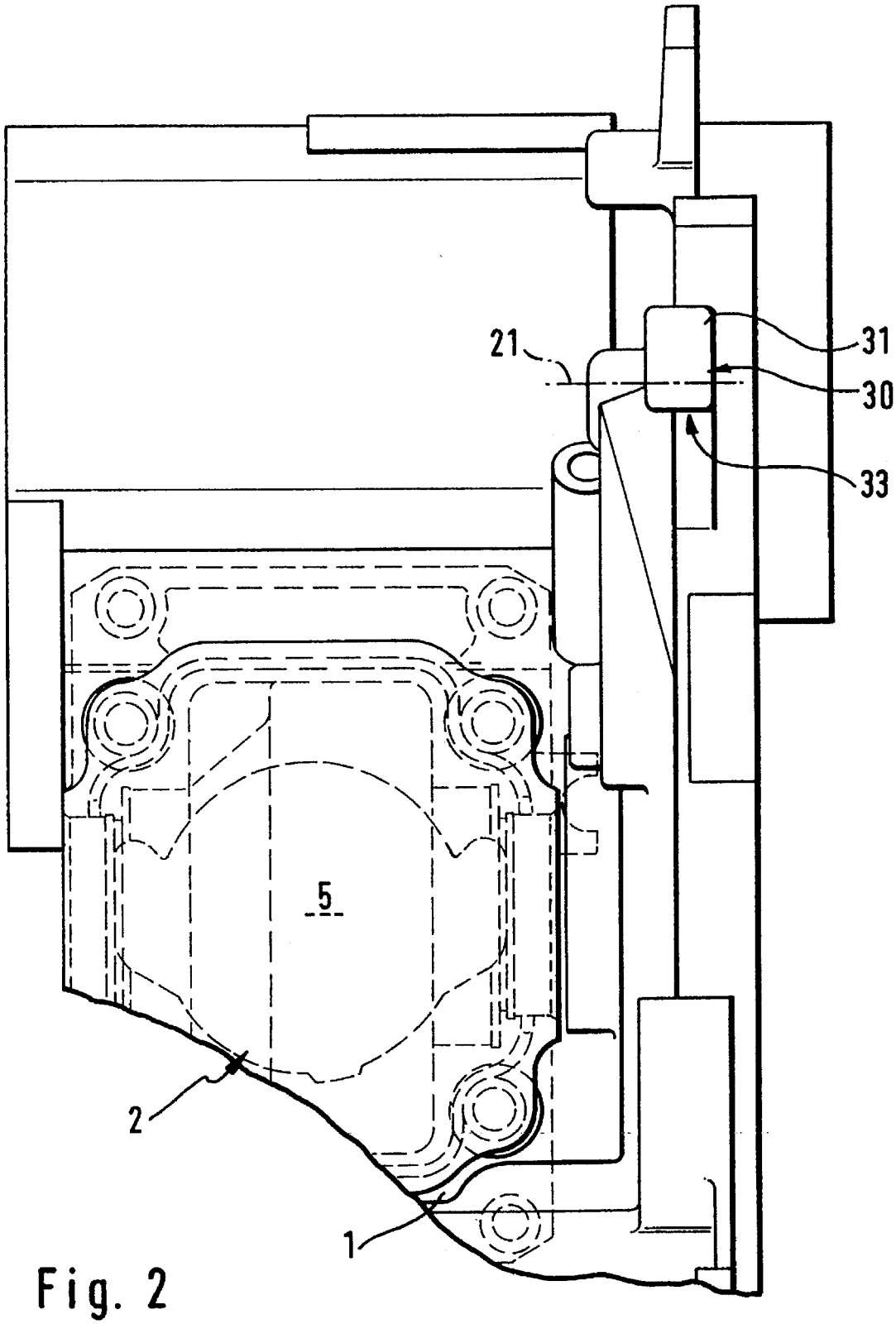
FIG. 2 is a plan view showing the bearing mount arranged fixedly on the motor housing of FIG. 1.
Figure 3:
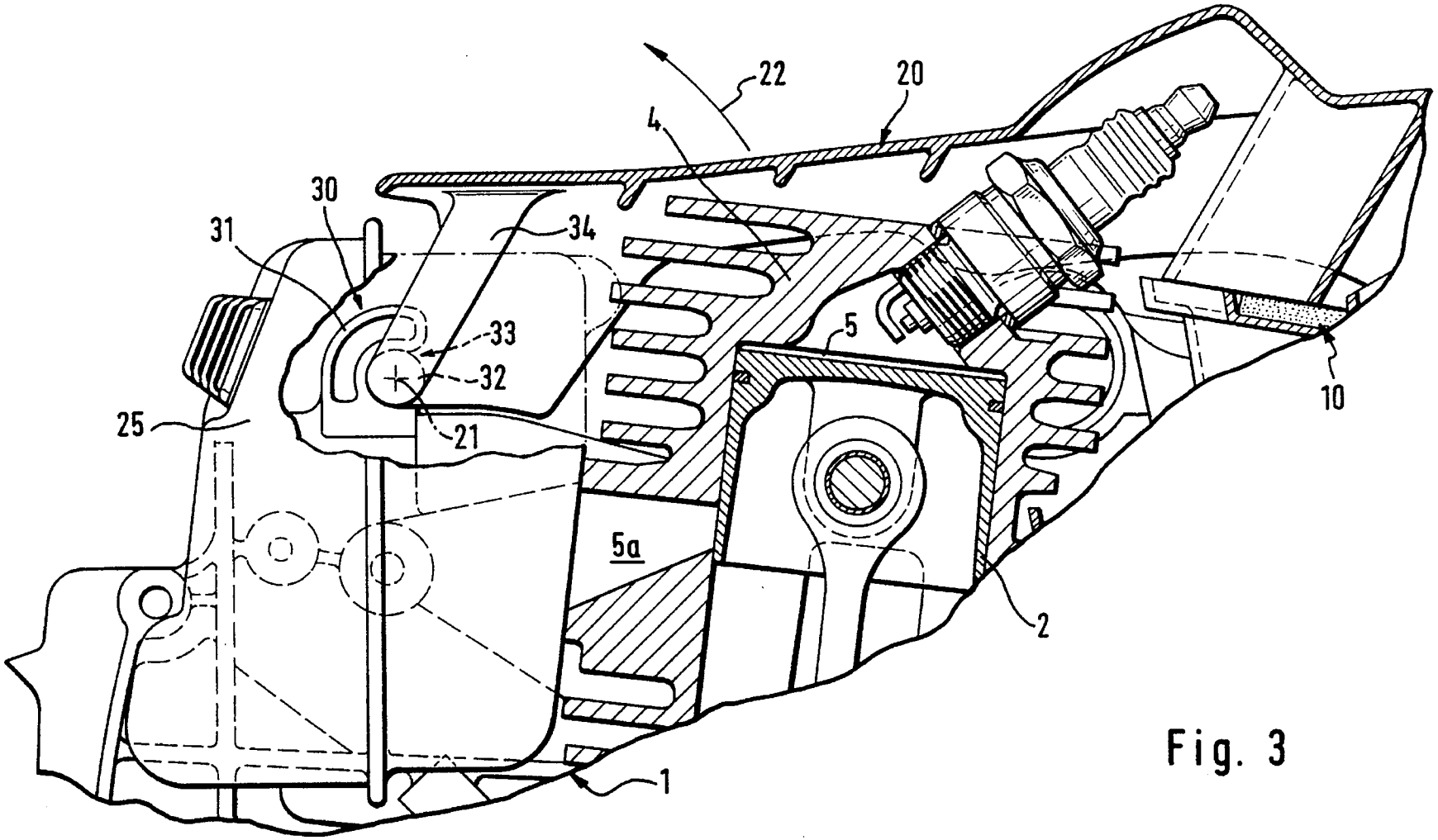
FIG. 3 is a detail view of the motor-driven chain saw of FIG. 1 showing a detail view of the bearing mount of FIG. 2.
Figure 4:
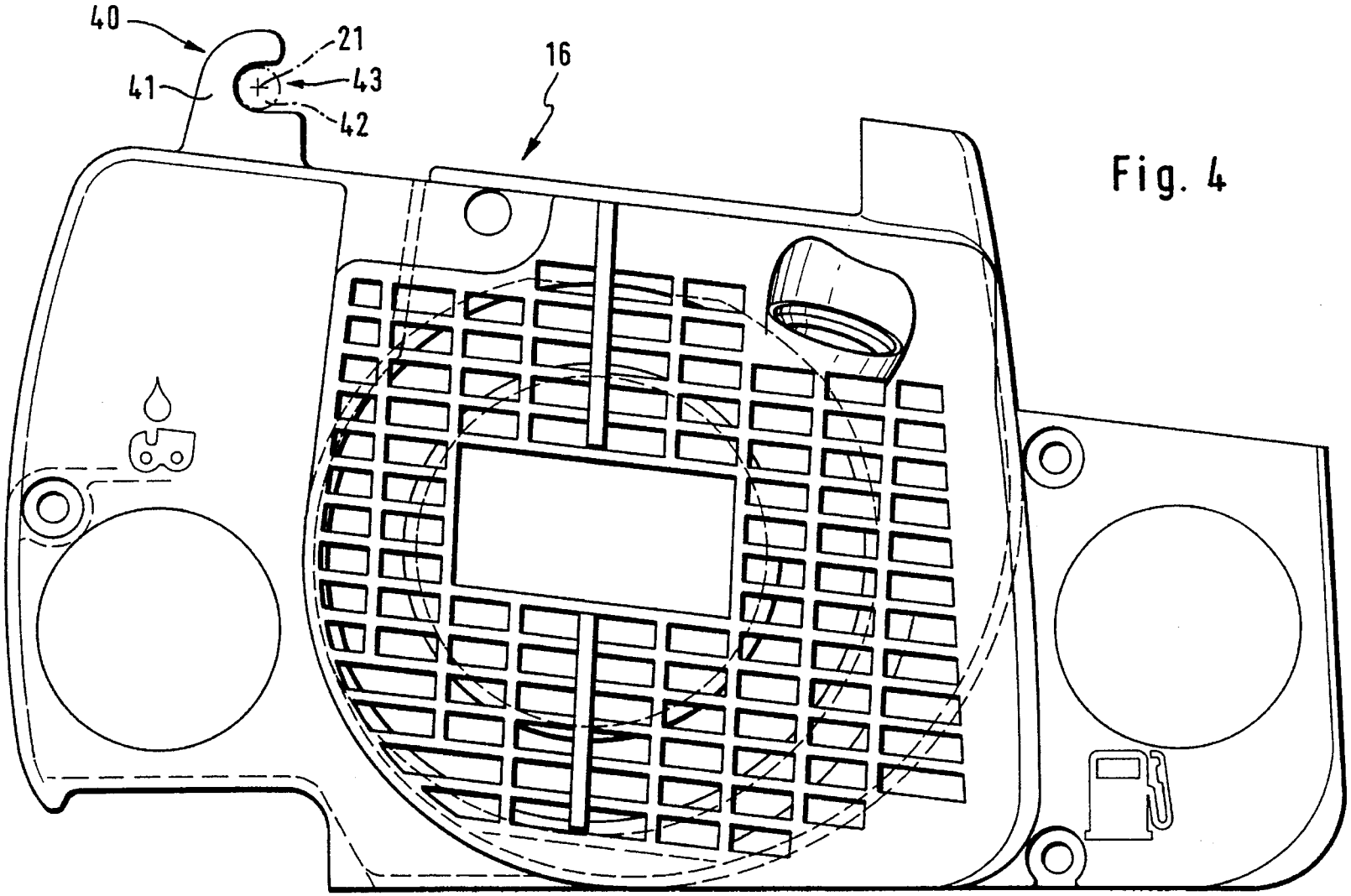
FIG. 4 is a side elevation view of a fan housing cover with a bearing mount arranged thereon.

As shown in FIGS. 2 to 4, the hood 20 is pivotally held in bearings (30, 40) about a pivot axis 21 in the direction of arrow 22 and opposite thereto. Starting from the end face 27, the hood 20 extends in the region of the rearward handle and essentially over the entire length of the motor housing up to the forward end face of the work apparatus. The hood 20 extends into the area of the forward hand guard 6*a* below the bail-like forward handle 6.

As shown in FIG. 5, the hood 20 has two opposite lying bearing pins (32, 42) which are disposed on the longitudinal sides of the hood 20 and are directed inwardly. The bearing pins (32, 42) are in the region of the open end of the hood 20 facing toward the forward end face of the work apparatus. The bearing pin 42 has a free end, whereas the bearing pin 32 is connected at both axial ends to the hood 20 via struts 34.

Bearing mounts (31, 41) are assigned to corresponding ones of bearing pins (32, 42) and are on respective longitudinal sides of the motor-driven chain saw. The bearing mount 31 is provided directly on the motor housing 1, whereas the other bearing mount 41 is provided on a fan housing cover 16. The fan housing cover 16 defines one longitudinal side of the work apparatus. Both bearings are mounted in the region of the forward end of the work apparatus in the region below the forward handle 6. Each bearing mount (31, 41) has a radial insert opening (33 or 43) which faces toward the engine 2 or the filter case 10. The insert opening extends in the peripheral direction of the bearing mount 31 over a peripheral angle of approximately 180° so that the bearing pins (32, 42) of the hood 20 can be easily inserted into the bearing mounts (31, 41).

To exchange a filter, the closure knob 24 is rotated so that the hood 20 can be pivoted about the axis 21 in the direction of arrow 22. In the open position, the hood can be pulled off in the direction toward the rearward handle 7. The bearing pins (32, 42) then exit from the bearing mounts (31, 41) corresponding thereto. The hood 20 extends over the engine 2. With the hood 20 removed, not only is the filter case 10 easily accessible but also the engine 2 and especially the spark plug thereof as well as the carburetor. This is so because the pivot axis 21 (when viewed from the rearward handle 7) is disposed forward of the engine 2 in the region of the exhaust-gas muffler 25. With the hood 20 removed, the air-filter element 15 can be cleaned in a simple manner or can be exchanged and the dirt which has possibly entered the smoothing compartment can be removed. After maintenance of the air filter, the following steps are carried out: the hood 20 is guided into the bearing mounts (31, 41) with corresponding ones of the bearing pins (32, 42), the hood 20 is closed in the direction opposite to arrow 22 and the closure knob 24 is rotated by 90° into its closed position. The hood 20 is latched tightly to the motor housing.

Figure 10:
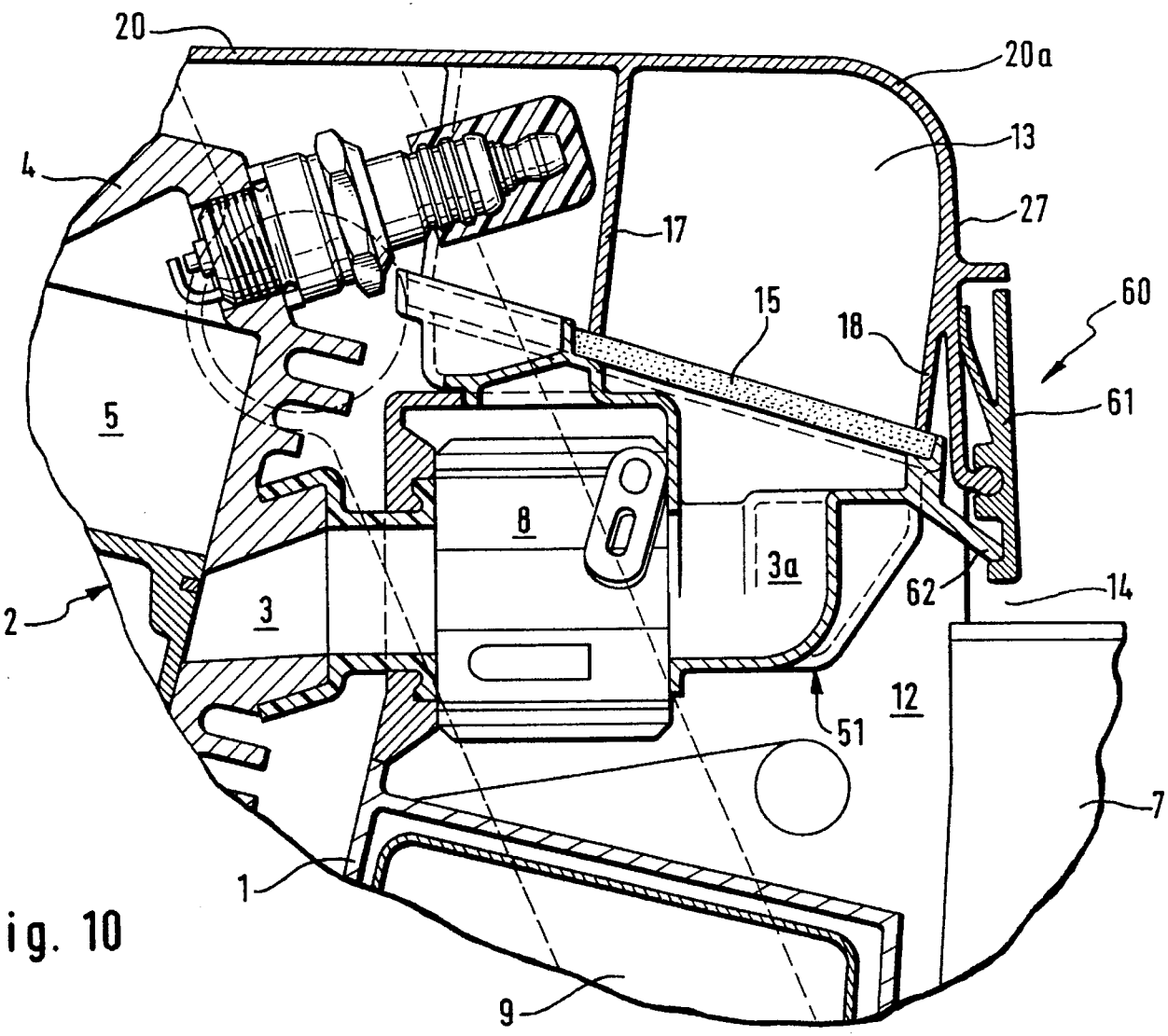

In the embodiment of FIG. 10, the closure device 60 is defined by a latch key 61 held resiliently on the end face 27 of the hood 20. The latch key 61 engages behind a latch nose 62 of the filter support assembly unit 51. In the embodiment of FIG. 10, the filter element 15 closes the inlet section 3*a* of the intake channel 3. Air entraining dirt enters via a housing opening 14 formed as a gap. This air laden with entrained dirt enters the smoothing compartment 13 via channels (not shown). The smoothing compartment 13 is delimited by boundary walls (17, 18) of the hood 20 and a hood section 20*a* above the filter element 15. The air passage from the dirt compartment 12 into the smoothing compartment 13, in turn, takes place via intake ducts (not shown) which are configured in the manner of Helmholtz tubes for noise attenuation.

In the embodiment of FIG. 1, the inlet section 3*a* projects through the filter element 15 in order to permit the intake channel 3 to be connected to the clean compartment 11 of the air-filter case 10. In the embodiment of FIG. 10, the clean compartment lies below the air-filter element 15 and the inlet section 3*a* opens directly into the clean compartment 11. A smoothing compartment 13 (or the dirt compartment) is configured above the air-filter element 15. The ambient air is drawn by suction through the housing opening 14 in the region of the forward end section of the rearward handle. This ambient air is conducted via intake ducts (not shown) to the smoothing compartment 13. Since the heavier particles cannot move in the flow toward the smoothing compartment 13, the coarse dirt drops down and precleaned ambient air enters into the smoothing chamber which then (after passing through the air-filter element 15) enters into the inlet section 3*a* as filtered combustion air.

It is understood that the foregoing description is that of the preferred embodiments of the invention and that various changes and modifications may be made thereto without departing from the spirit and scope of the invention as defined in the appended claims.

What is claimed is:

1. A portable handheld apparatus such as a motor-driven chain saw, cutoff machine or the like, the apparatus having a work tool and comprising:

a housing having an opening through which ambient air flows into the housing;

an internal combustion engine for driving said work tool;

said engine being mounted in said housing and having an air-intake channel;

said housing including a filter case arranged therein;

an air filter mounted in said filter case and partitioning said filter case into a first compartment communicating with said opening for receiving said ambient air and a clean compartment for receiving air for combustion through said air filter from said first compartment;

said air-intake channel being arranged in said housing so as to communicate with said clean compartment for receiving filtered air for combustion in said engine;

said housing having a hood covering said filter case; and, pivot bearing means for pivotally connecting said hood to said housing.

2. The portable handheld apparatus of claim 1, said housing defining a longitudinal axis and having a predetermined length measured along said axis; and, said hood extending approximately over said length of said housing.

3. The portable handheld apparatus of claim 2, said housing having first and second longitudinal sides extending in the direction of said axis; and, said pivot bearing means including respective bearing mounts on said sides.

4. The portable handheld apparatus of claim 3, said housing having a base wall and a forward end; and, said apparatus further comprising a forward bail handle attached to said housing at said base wall; and, said bearing units being disposed at said forward end below said forward bail handle.

5. The portable handheld apparatus of claim 4, further comprising a fan housing cover mounted on one of said longitudinal sides and one of said bearing mounts being mounted on said fan housing cover.

6. The portable handheld apparatus of claim 3, said bearing mounts being fixedly attached to said housing; and, said pivot bearing means further including pivot pins formed on said hood for pivotally engaging corresponding ones of said bearing mounts.

7. The portable handheld apparatus of claim 6, each of said bearing mounts having a radial insert opening to receive one of said pivot pins therein; and, each of the radial inserts being disposed so as to face toward said filter case.

8. The portable handheld apparatus of claim 1, said filter case having a filter support and said filter support and said hood conjointly delimiting said clean compartment; said air filter facing toward said clean compartment; and, said hood including holders for holding said air filter in place on said support.

9. The portable handheld apparatus of claim 8, said air-intake channel extending through said air filter for opening in said clean compartment.

10. The portable handheld apparatus of claim 9, said holders being formed on said hood as boundary walls of said clean compartment.

11. The portable handheld apparatus of claim 8, said first compartment being a smoothing compartment; said filter support defining a partition wall between said smoothing compartment and said clean compartment; said filter case further including a dirt compartment; and, duct means for connecting said smoothing compartment to said dirt compartment.

12. The portable handheld apparatus of claim 11, said air-intake channel including an inlet section; and, said filter support, said inlet section, said smoothing compartment and said duct means conjointly defining a one-piece assembly unit.

13. The portable handheld apparatus of claim 2, further comprising a rearward handle extending rearwardly in the direction of said longitudinal axis; and, said rearward handle and said housing conjointly defining said opening.

14. The portable handheld apparatus of claim 13, further comprising vibration attenuation means interposed between said rearward handle and said housing; and, said opening defining a swing gap between said rearward handle and said housing.

* * * * *